United States Patent [19]

Kukuck et al.

[11] Patent Number: 4,597,860

[45] Date of Patent: Jul. 1, 1986

[54] COIL ARRANGEMENT FOR A MAGNETIC SEPARATOR HAVING A STRONG FIELD

[75] Inventors: Karl-Heinz Kukuck, Ennigerloh; Werner Baran, Essen, both of Fed. Rep. of Germany

[73] Assignee: Krupp Polysius AG, Beckum, Fed. Rep. of Germany

[21] Appl. No.: 730,950

[22] Filed: May 6, 1985

[30] Foreign Application Priority Data

May 18, 1984 [DE] Fed. Rep. of Germany ..... 3418580

[51] Int. Cl.[4] ..... B03C 1/02

[52] U.S. Cl. ..... 209/223 A; 209/215; 209/217; 209/232; 210/222; 210/223

[58] Field of Search ..... 209/217, 223 A, 215, 209/232; 335/251, 252, 256, 299, 305; 210/222, 223

[56] References Cited

U.S. PATENT DOCUMENTS

| | | | |
|---|---|---|---|
| 1,236,177 | 8/1917 | Jacobs | 335/256 |
| 2,430,157 | 11/1947 | Byrd, Jr. | 209/215 UX |
| 2,895,090 | 7/1959 | Short | 335/256 |
| 3,503,022 | 3/1970 | Burdett | 335/256 |
| 3,838,773 | 10/1974 | Kolm | 209/223 X |
| 3,873,448 | 3/1975 | Isberg et al. | 210/222 |
| 4,110,222 | 8/1978 | Watson | 209/223 R |
| 4,190,524 | 2/1980 | Watson | 209/232 X |

*Primary Examiner*—Arthur Kellogg

*Attorney, Agent, or Firm*—Learman & McCulloch

[57] ABSTRACT

The invention relates to a coil arrangement for a magnetic separator having a strong field, in which the solenoid coils are provided in the first part only of the length of the housing and a magnetic shunt is arranged between the first and second parts of the length of the housing. A considerable reduction in the coil weight is achieved by such a construction.

9 Claims, 3 Drawing Figures

COIL ARRANGEMENT FOR A MAGNETIC SEPARATOR HAVING A STRONG FIELD

This invention relates to a magnetic separator of the type having a magnetic housing through which a channel extends for the passage of material containing magnetic material to be removed therefrom. The housing supports a plurality of electrical coils by means of which magnetic fields are generated.

In a known construction a coil of relatively large dimensions is positioned at the beginning of the channel and the remainder of the coils are of smaller dimensions. This construction has the disadvantage that the coil arrangement has a high weight with consequent high costs.

An objective of the invention is to provide a magnetic separator of the general class described and in which the coil weight is significantly reduced without reduction of the magnetic field strength.

The foregoing objective is achieved by the provision of a magnetic housing having the conventional channel extending therethrough and wherein the channel is encircled by two coils only in the region of the beginning of the channels. Between the ends of the channel is located a magnetic shunt, and downstream from the shunt the housing is free of coils.

The apparatus constructed according to the invention is disclosed in greater detail in the following description and the accompanying drawings wherein.

Figure 1:
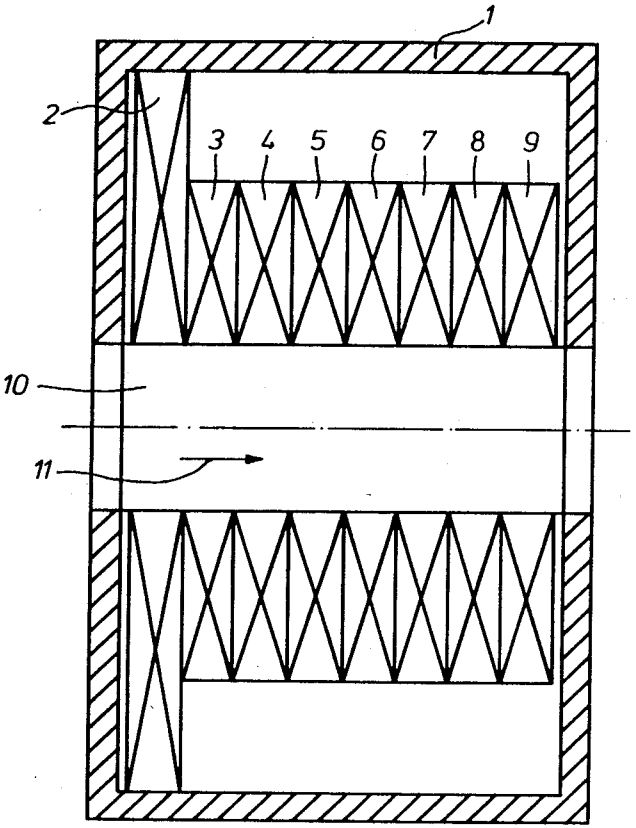
FIG. 1 is a diagrammatic, sectional view of a known magnetic separator.

A known coil arrangement for a magnetic separator is illustrated in FIG. 1. This coil arrangement contains a total of eight coils 2 to 9 in a housing 1 which is made from a weakly magnetic material, preferably steel. Of these coils the coil 2 with the relatively large dimensions generates a comparatively high magnetic field strength in the first part of the length of a channel 10 passing through the housing 1 and encircled by the coils, whereas a lower magnetic field strength is produced in the second part of the length of this channel 10 by the coils 3 to 9 which are of smaller dimensions. The first part of the length of the channel 10 which is encircled by the large coil 2 thus forms the socalled catching zone in which the material to be subjected to magnetic separation is delivered to the moving matrix (not shown) and in which the magnetic constituents of the material rest on the induction bodies forming the matrix. The second part of the length of the channel 10 encircled by the smaller coils 3 to 9 forms the socalled holding zone in which the magnetic constituents adhering to the induction bodies of the matrix are washed and the non-magnetic particles are separated off. During this the matrix moves in the direction of the arrow 11 through the channel 10.

The housing 1 serves as a mechanical receptacle for the coils 2 to 9 and it also forms a magnetic short circuit for the magnetic flux. Finally, it forms a casing for the cooling medium (usually oil) used for cooling the coils.

As will be seen from the Table below which explains one practical embodiment, the known coil arrangement shown in FIG. 1 has a considerable coil weight which leads to comparatively high costs for the coil arrangement.

The object of the invention, therefore, is to construct a coil arrangement of the type set out in the preamble to claim 1 in such a way that the coil weight and with it the weight of the whole arrangement is significantly reduced while the magnetic field strength remains the same.

This object is achieved according to the invention by the characterising features of claim 1.

Advantageous embodiments of the invention are the subject matter of the subordinate claims.

Figure 2:
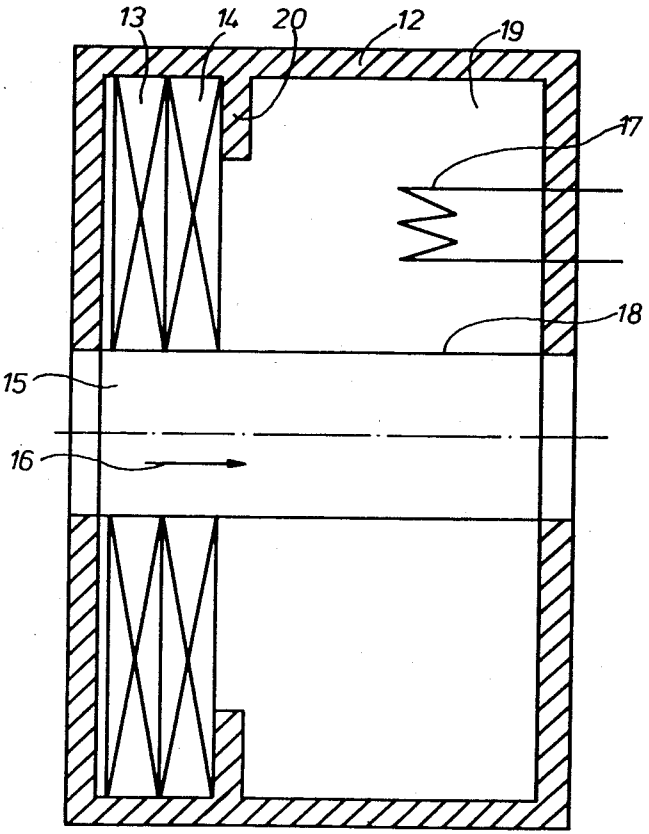
FIG. 2 is a view similar to FIG. 1, but illustrating a magnetic separator constructed in accordance with the invention.

An embodiment of the invention is illustrated in FIG. 2.

An embodiment of a magnetic separator constructed in accordance with the invention is illustrated in FIG. 2. This embodiment comprises a housing 12 formed of weak magnetic material such as steel and defining a channel encircled by only two solenoid coils 13, 14 both of which are located in the first or beginning (left-hand) part of the channel 15 which passes through the solenoid coils 13, 14 and through which the matrix (which is not shown) moves in the direction of the arrow 16 during operation.

A cooling heat exchanger 17 for the cooling medium for the coil arrangement (preferably oil) is located in the coil-free (right-hand) part of the length of the housing 12. A tunnel wall 18 separates the chamber 19 which is filled with the cooling medium from the channel 15.

A magnetic shunt 20 which is formed by an annular wall of flange the radial breadth of which amounts to 15 to 50%, preferably 20 to 30%, of the housing radius is located between the first part of the length of the housing accommodating the solenoid coils 13, 14 and the coil-free second part of the length of the housing.

The technical advance which is achieved by the invention is explained in greater detail with the aid of the Table below and FIG. 3.

The technical data for a practical embodiment of the known arrangement (according to FIG. 1) and for the arrangement according to the invention (FIG. 2) are compared in the Table. It may be assumed here that in both cases the thickness of the left-hand end wall of the housing is 90 mm and that of the right-hand end wall is 60 mm. In the case of FIG. 1 the peripheral wall of the housing has a thickness of 60 mm, and in the case of FIG. 2 a thickness of 100 mm. In addition the magnetic shunt 20 according to FIG. 2 has a radial breadth of 160 mm.

TABLE

| | FIG. 1 | FIG. 2 |
|---|---|---|
| 1st coil (ampere turns) | 350 000 | 229 000 |
| additional coil(s) (ampere turns) | 11 200 | 229 000 |
| coils altogether (ampere turns) | 428 400 | 458 000 |
| coil weight total kg | 1 580 | 594 |
| housing weight kg | 2 050 | 2 650 |
| power consumption kW | 265 | 244 |

It will be seen from this Table that a considerable reduction in the coil weight is achieved, as well as a certain reduction in the electrical power consumption. The increase in the housing weight is not serious since it clearly is below the weight saving on the coils and in addition the steel is relatively cheap (the coil price per unit of weight is a multiple of the housing price).

Figure 3:
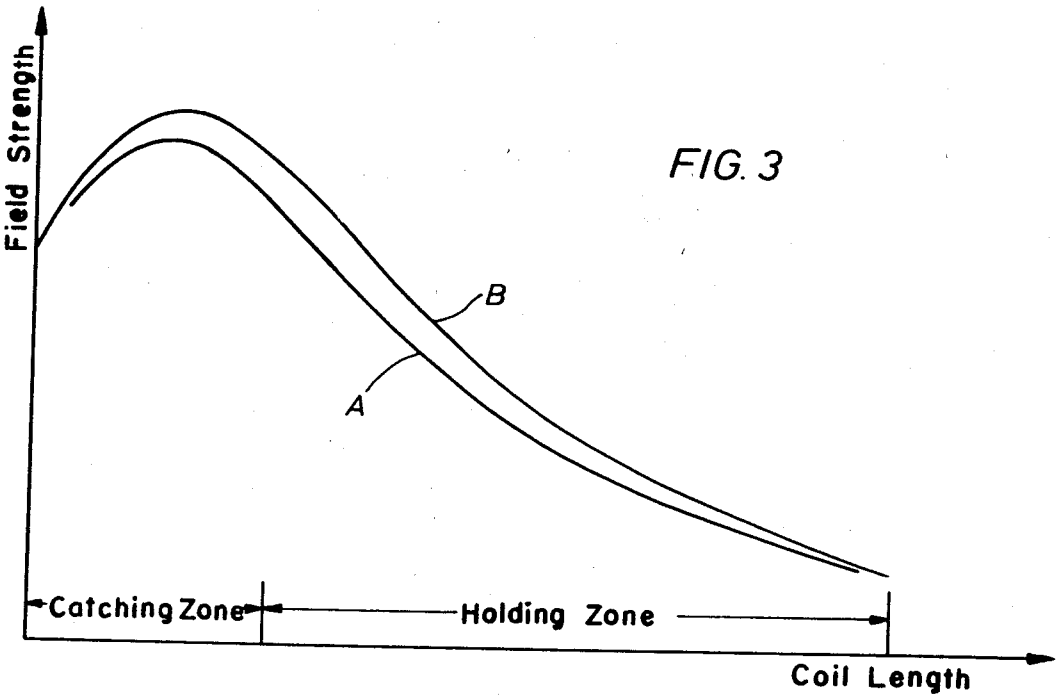
FIG. 3 is a graph on which the magnetic field strengths of the constructions according to FIGS. 1 and 2 are plotted.

FIG. 3 plots the magnetic field strength inside the coil arrangement for both cases. Curve A shows the field strength for the case of FIG. 1 and curve B the field strength for the case of FIG. 2. The first part of the curve corresponds to the catching zone (high field strength) and the second part of the curve corresponds to the holding zone (reduced field strength).

Apart from the advantages already mentioned of a considerable reduction in the coil weight and a certain reduction in the electrical power consumption, the arrangement according to the invention has the further advantage that the cooling heat exchanger 17 can be accommodated in the coil-free second part of the length of the housing and therefore does not require any space outside the coil arrangement.

Although in the illustrated embodiment of the invention the solenoid coil system contains two coils 13, 14 of equal size, constructions are also possible within the scope of the invention in which the solenoid coil system provided in the first part of the length of the housing only has one coil.

We claim:

1. In a magnetic separator having an annular housing formed of weak magnetic material and through which extends a channel having an inlet and an outlet, the improvement comprising at least one magnetic coil encircling said channel adjacent the inlet thereof, and a magnetic shunt between the inlet and the outlet of said channel, that portion of said channel between said outlet and said shunt being free of magnetic coils.

2. A magnetic separator according to claim 1 including more than one magnetic coil between said inlet of said channel and said shunt.

3. A magnetic separator according to claim 2 wherein each of said magnetic coils is of uniform size.

4. A magnetic separator according to claim 2 wherein not more than two of said magnetic coils are positioned between said inlet and said shunt.

5. A magnetic separator according to claim 4 wherein each of said magnetic coils is of uniform size.

6. A magnetic separator according to claim 6 including means forming a cooling medium chamber in said housing between said shunt and said outlet.

7. A magnetic separator according to claim 6 including heat exchange means positioned in said chamber.

8. A magnetic separator according to claim 1 wherein said shunt comprises an annular flange extending radially inwardly of said channel and having a radial breadth between about 15% and 50% of the radius of said housing.

9. A magnetic separator according to claim 8 wherein the radial breadth of said flange is between about 20% and 30% of the radius of said housing.

* * * * *

UNITED STATES PATENT AND TRADEMARK OFFICE

CERTIFICATE OF CORRECTION

PATENT NO. : 4,597,860

DATED : July 1, 1986

INVENTOR(S) : Karl-Heinz Kukuck et al

It is certified that error appears in the above-identified patent and that said Letters Patent are hereby corrected as shown below:

Column 2, line 32, change "of" first occurrence to --or--.

Column 4, line 15, change "claim 6" to --claim 1--.

Signed and Sealed this

Seventh Day of October, 1986

[SEAL]

*Attest:*

DONALD J. QUIGG

*Attesting Officer*

*Commissioner of Patents and Trademarks*